US008752990B2

(12) United States Patent
Okada et al.

(10) Patent No.: US 8,752,990 B2
(45) Date of Patent: Jun. 17, 2014

(54) VEHICLE LIGHT

(75) Inventors: Hidetaka Okada, Tokyo (JP); Takuya Matsumaru, Tokyo (JP); Kazuya Makiuchi, Tokyo (JP)

(73) Assignee: Stanley Electric Co., Ltd., Tokyo (JP)

( * ) Notice: Subject to any disclaimer, the term of this patent is extended or adjusted under 35 U.S.C. 154(b) by 206 days.

(21) Appl. No.: 13/310,523

(22) Filed: Dec. 2, 2011

(65) Prior Publication Data

US 2012/0163031 A1 Jun. 28, 2012

(30) Foreign Application Priority Data

Dec. 2, 2010 (JP) ..... 2010-268886

(51) Int. Cl.
*F21V 13/04* (2006.01)

(52) U.S. Cl.
USPC ..... 362/516; 362/507; 362/511; 362/545

(58) Field of Classification Search
USPC ..... 362/507, 511, 516, 545
See application file for complete search history.

(56) References Cited

U.S. PATENT DOCUMENTS 6,585,402 B2 * 7/2003 Ohkodo et al. ..... 362/554
8,113,701 B2 * 2/2012 Ishikawa ..... 362/545
8,292,480 B2 * 10/2012 Koizumi et al. ..... 362/545
8,454,214 B2 * 6/2013 Kazaoka ..... 362/511
2008/0186726 A1 8/2008 Okada
2010/0008088 A1 1/2010 Koizumi et al.
2013/0044491 A1 * 2/2013 Chen et al. ..... 362/294

FOREIGN PATENT DOCUMENTS

JP 2008-186786 A 8/2008
JP 2010-21001 A 1/2010

* cited by examiner

*Primary Examiner* — Stephen F Husar
*Assistant Examiner* — James Cranson, Jr.
(74) *Attorney, Agent, or Firm* — Kenealy Vaidya LLP

(57) ABSTRACT

A vehicle light can allow light to be emitted more uniformly through an elongated area from a fewer number of light sources as compared with a conventional one. The vehicle light can include an outer lens, a plurality of light sources arranged along the outer edge of the outer lens for emitting light in an optical axis direction orthogonal to the arraying direction thereof, an inner lens including a light guide portion elongated in the arraying direction of the light sources and disposed along the optical axis of the light sources, for dispersing the light in a longitudinal direction of the lens and emitting in the optical axis direction, and a first diffusion reflector and second diffusion reflectors configured to be elongated in the longitudinal direction of the inner lens and disposed in the optical axis direction of the lens.

14 Claims, 6 Drawing Sheets

VEHICLE LIGHT

This application claims the priority benefit under 35 U.S.C. §119 of Japanese Patent Application No. 2010-268886 filed on Dec. 2, 2010, which is hereby incorporated in its entirety by reference.

TECHNICAL FIELD

The presently disclosed subject matter relates to a vehicle light.

BACKGROUND ART

Japanese Patent Application Laid-Open Nos. 2010-21001 and 2008-186786 discloses that some vehicle lights such as vehicle headlamps are conventionally known which allow a beam of light incident upon an end face of a light guide plate (or a lens) to be transmitted from the front end face of the light guide plate.

The vehicle lights disclosed in these patent references employ a light guide plate having a reflective structure such as reflective dots on the rear end face, so that the light incident upon the lower face of the light guide plate can be reflected by the reflective structure provided on the rear end face and then transmitted from the front end face, thereby allowing the front end face of the light guide plate to emit light.

However, the vehicle lights disclosed in the above patent references can control the light incident on the lower face of the light guide plate not in the right-to-left direction but only in the back-and-forth direction. Thus, in the conventional art, it may not always be possible for one light source to emit light from an area widened in the right-to-left direction on the front end face of the light guide plate. Accordingly, in the conventional art, to emit light from a widened area on the front end face of the light guide plate elongated in the right-to-left direction, a number of light sources have to be disposed in the right-to-left direction, which may lead to additional parts costs.

Furthermore, the vehicle lights disclosed in the above patent references only allow the light reflected by the reflective structure provided on the rear end face of the light guide plate to be transmitted from the front end face of the light guide plate. This may cause variations in brightness depending on the distance from the light source in a manner such that a portion on the front end face closer to the light source can emit light at a greater intensity. It may not, therefore, be possible to provide uniform emission through the front end face of the light guide plate. In particular, the reflective structure with a plurality of reflective dots formed on the rear end face of the light guide plate would cause the vicinity of the reflective dots to transmit light through the front end face of the light guide plate at a greater intensity when compared with the other portions. Thus, this would also cause variations in brightness depending on the distance from the reflective dots in addition to variations in brightness depending on the distance from the light source.

SUMMARY

The presently disclosed subject matter was devised in view of these and other problems and features and in association with the conventional art. According to an aspect of the presently disclosed subject matter, a vehicle light is provided which can allow light to be emitted more uniformly through an elongated area using a fewer number of light sources as compared with a conventional system.

According to another aspect of the presently disclosed subject matter, a vehicle light can include:

a plurality of light sources arranged in a predetermined array direction, each light source having an optical axis orthogonal to the array direction, and each light source emitting light in a direction of the optical axis;

a lens elongated in the array direction and disposed in the optical axis direction of the plurality of light sources to transmit light emitted from the plurality of light sources in the optical axis direction, the light being dispersed in a longitudinal direction of the lens; and a diffusion reflector elongated in the longitudinal direction of the lens and disposed in the optical axis direction of the lens to diffuse and reflect the light emitted from the lens.

In the vehicle light with the above configuration, the lens can be formed in such a shape that a plurality of light guide blocks associated with the plurality of light sources are coupled in the longitudinal direction of the lens, and the plurality of light guide blocks can each include: an incidence face opposed to the light source; a first reflecting face for internally reflecting light in the longitudinal direction of the lens, the light having passed through the incidence face into the light guide block; a plurality of second reflecting faces for internally reflecting in the optical axis direction of the lens the light having been internally reflected from the first reflecting face, those of the second reflecting faces located farther away in the longitudinal direction of the lens from the light source opposed to the incidence face being arranged to be more aligned with the optical axis direction; and an emission face for allowing the light internally reflected from the plurality of second reflecting faces to be projected out of the light guide block.

In the vehicle light with the above configuration, the lens can have a diffusing portion for further diffusing the light having been diffused and reflected by the diffusion reflector.

In the vehicle light with the above configuration, the diffusion reflector can be painted white or formed of a white-colored raw material.

In the vehicle light with the above configuration, the array direction and the longitudinal direction can be oriented along an outer edge of the vehicle light.

According to the presently disclosed subject matter, the light emitted from the plurality of light sources in the optical axis direction orthogonal to the array direction thereof can be dispersed through the lens in the longitudinal direction of the lens that is elongated along the array direction of the plurality of light sources. Accordingly, when compared with the conventional vehicle light which provides little or no control to the light in the longitudinal direction of the lens (the light guide plate), fewer light sources are sufficient to be able to provide emission through the elongated area along the longitudinal direction.

Furthermore, the light emitted from the lens can be diffused and reflected by the diffusion reflector elongated in the longitudinal direction of the lens. Accordingly, unlike the conventional vehicle light which employs a reflective structure, such as reflective dots to simply reflect light thereon in order to provide emission from the front end face of the lens (light guide plate), variations in brightness depending on the distance from the light source or the reflective dots can be prevented or the variations in brightness can be alleviated, and thus more uniform light emission can be provided through the elongated area along the longitudinal direction.

BRIEF DESCRIPTION OF DRAWINGS

These and other characteristics, features, and advantages of the presently disclosed subject matter will become clear from the following description with reference to the accompanying drawings, wherein.

DETAILED DESCRIPTION OF EXEMPLARY EMBODIMENTS

A description will now be made below to vehicle lights of the presently disclosed subject matter with reference to the accompanying drawings in accordance with exemplary embodiments.

Figure 1:
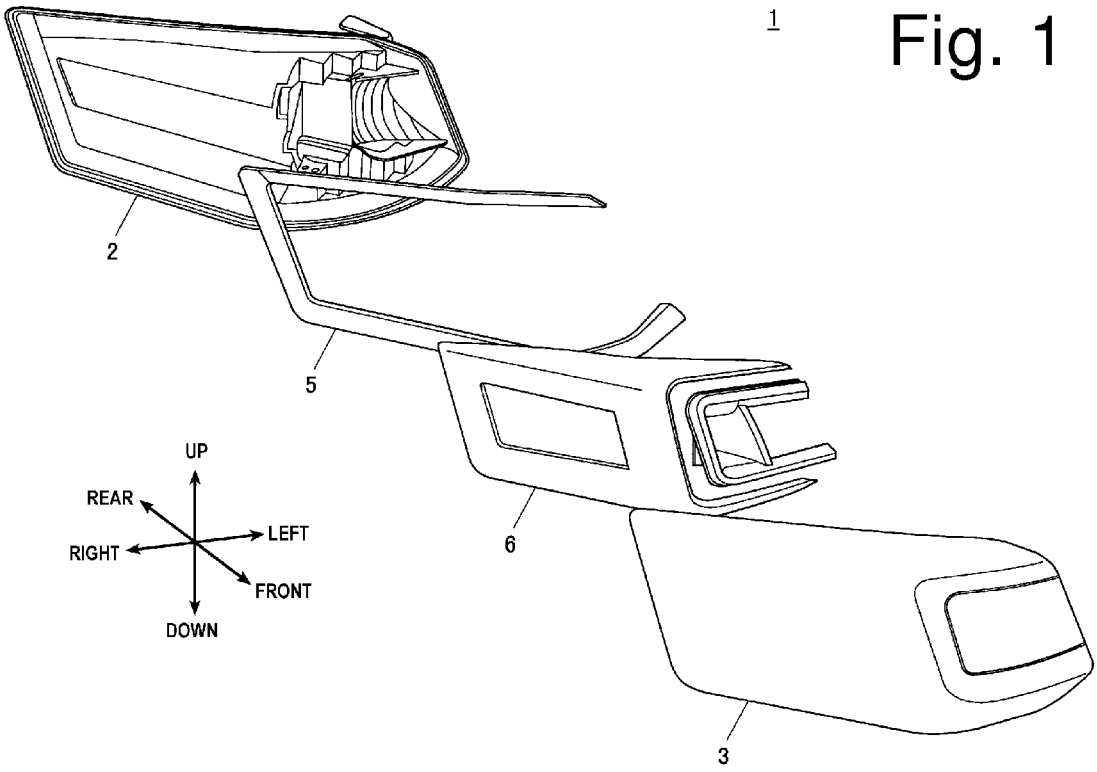
FIG. 1 is an exploded perspective view illustrating a vehicle light according to an exemplary embodiment made in accordance with principles of the presently disclosed subject matter.
Figure 2:
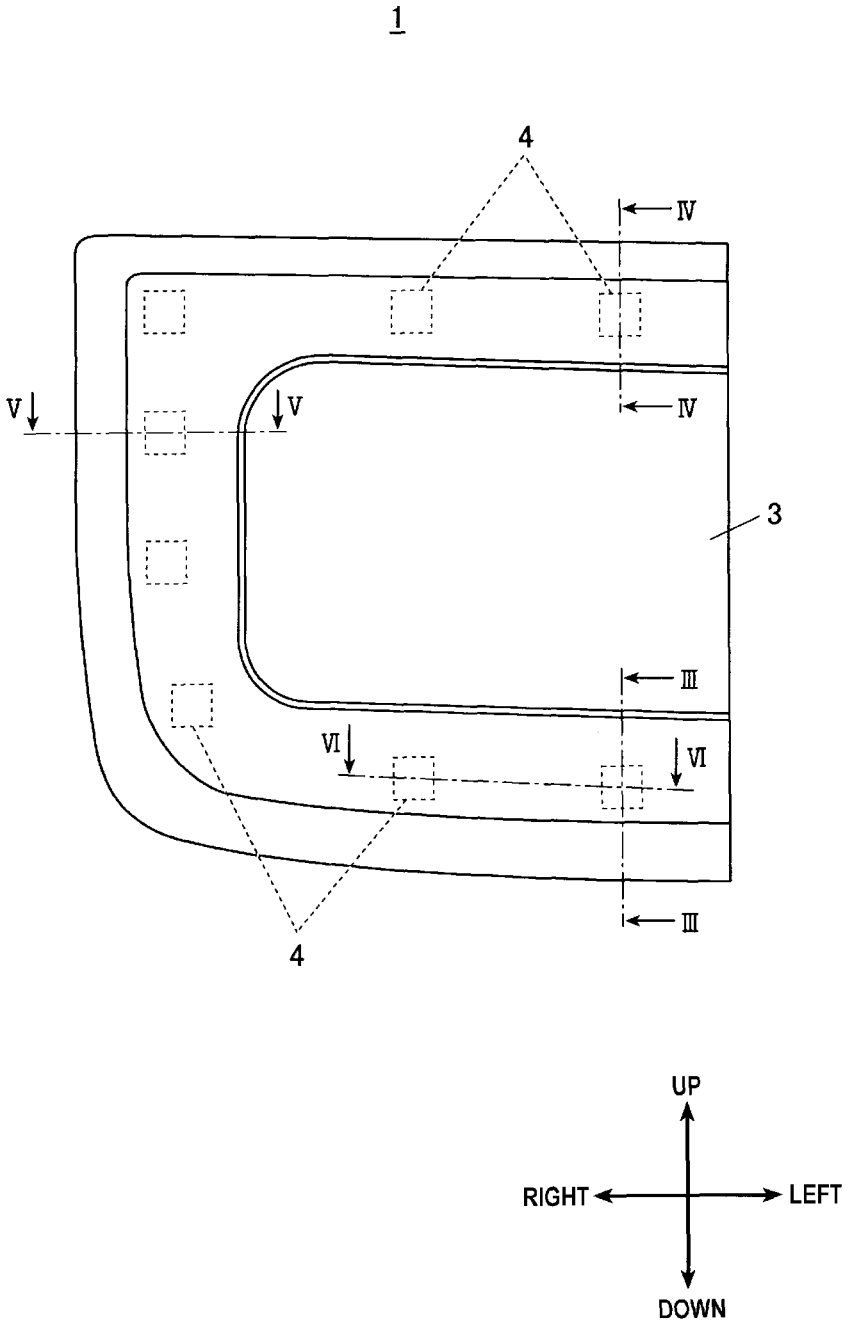
FIG. 2 is a front view illustrating a vehicle light according to the exemplary embodiment.

FIG. 1 is an exploded perspective view illustrating a vehicle light 1 according to an exemplary embodiment. FIG. 2 is a front view illustrating the vehicle light 1, and FIGS. 3 to 6 are cross-sectional views taken along lines III-III to VI-VI of FIG. 2, respectively.

Note that the vehicle light according to this exemplary embodiment can be a rear lamp to be mounted on each of the right and left sides at the rear portion of a vehicle (not shown). A description will be made below only to the vehicle light 1 that is mounted on the left of the rear portion of the vehicle as an example. Furthermore, in the description below, unless otherwise specified, the terms, "upper (up)," "lower (down)," "forward (front)," "rearward (rear, back)," "left," "right," "inner," and "outer" will be used to refer to the directions when viewed from the vehicle light 1 in conjunction with the illustrations of the drawings.

As shown in FIG. 1, the vehicle light 1 can include a housing 2 with the front end opened. The front end opening of the housing 2 can be formed to have an upper side that is inclined diagonally in the rightward and backward direction, a front lower side arranged generally in the right-to-left direction, a right lower side that is inclined slightly rightward from the right end of the front lower side toward the rear, and a right side which connects generally in the vertical direction between the rear ends of the upper side and the right lower side.

Figure 3:
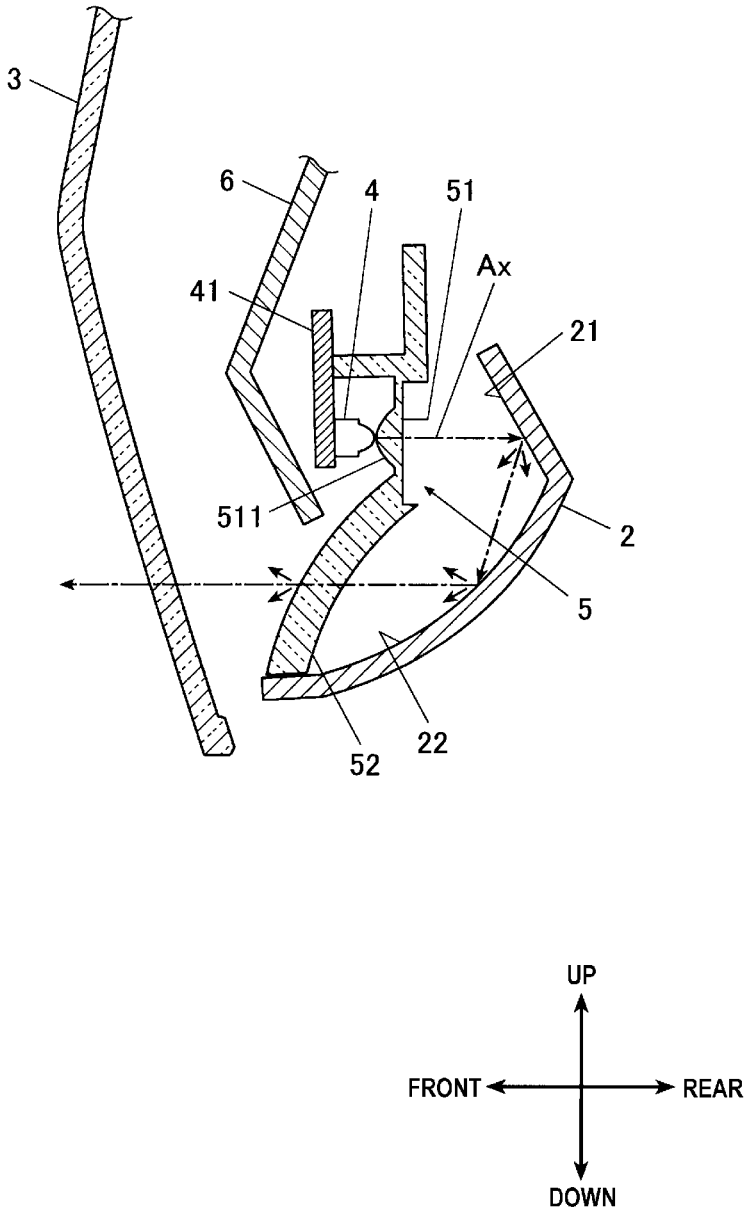
FIG. 3 is a cross-sectional view taken along line III-III of FIG. 2.
Figure 4:
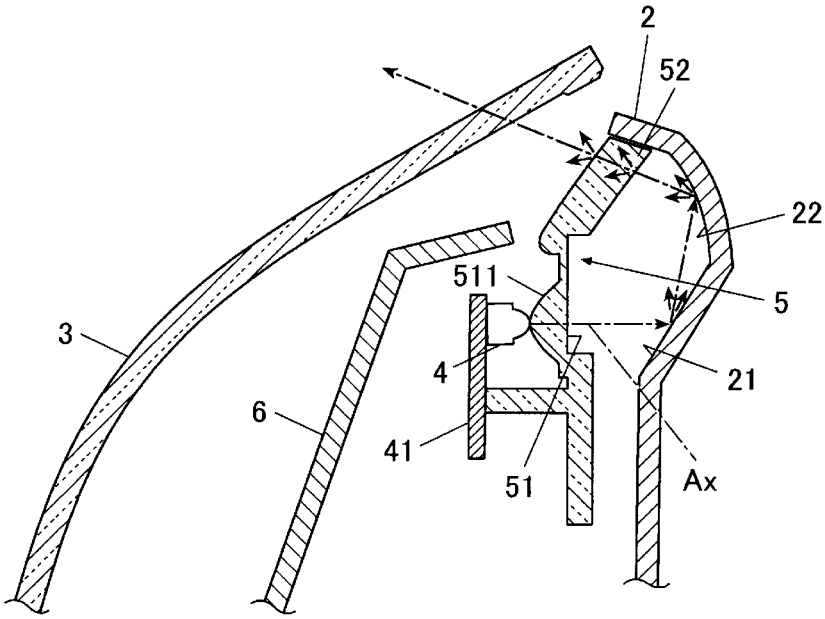
FIG. 4 is a cross-sectional view taken along line IV-IV of FIG. 2.
Figure 4:
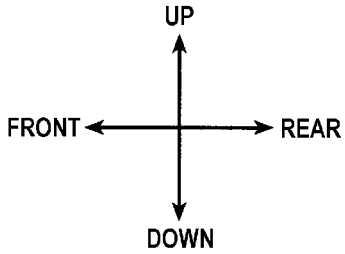
Figure 5:
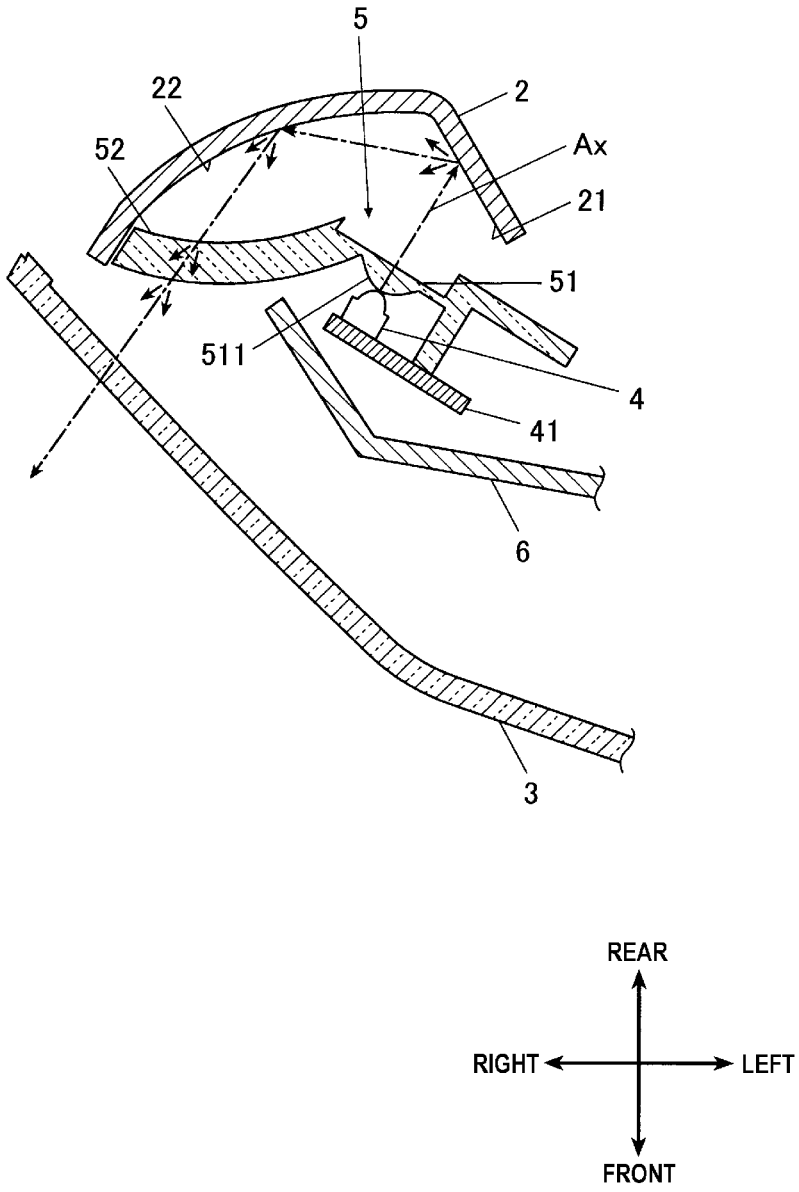
FIG. 5 is a cross-sectional view taken along line V-V of FIG. 2.

As shown in FIGS. 3 to 5, the outer edge of the housing 2 (the outer edge of the front end opening) can be inflected in the forward direction, so that a front end face located at an inward position relative to the inflection can constitute a first diffusion reflector 21, and a front end face located at an outward position can constitute the second diffusion reflector 22. The first diffusion reflector 21 can be formed in a planar shape that is outwardly inclined and the second diffusion reflector 22 can be formed in a curved shape that is curved in the forward direction, with both the reflectors painted white by surface treatment to diffuse and reflect light. Note that the first diffusion reflector 21 and the second diffusion reflector 22 may not be painted white but may also be formed of a white-colored raw material.

As shown in FIG. 1, in front of the housing 2, there can be disposed an outer lens 3 to cover the front end opening of the housing 2. The outer lens 3 can be an optically transparent member and formed in the shape of the periphery along the outer edge of the housing 2. The lighting chamber that can be formed of the outer lens 3 and the housing 2 accommodates a plurality of light sources 4 (see FIG. 2), an inner lens 5, and an extension 6.

Of these components, the light sources 4 can be a light emitter such as a light-emitting diode, and as shown in FIG. 2, and can be arranged at predetermined intervals along the upper side, the front lower side, the right lower side, and the right side of the outer edge of the outer lens 3 (the housing 2). As shown in FIGS. 3 to 6, the light source 4 can be mounted on a substrate 41 with the optical axis Ax (the light source optical axis) oriented in a direction orthogonal to the direction in which the light sources 4 are arranged. The light sources 4 can also be opposed to the first diffusion reflector 21. More specifically, those of the light sources 4 which are arranged along the front lower side of the outer edge of the housing 2 can be disposed in front of the first diffusion reflector 21 with the optical axis Ax oriented in the backward direction, whereas those which are arranged along the upper side, the right lower side, and the right side of the outer edge of the housing 2 can be disposed diagonally rightward and forward relative to the first diffusion reflector 21 with the optical axis Ax oriented in the diagonally leftward and backward direction.

As shown in FIG. 1, the inner lens 5 can be an optically transparent member which can be elongated along the upper side, the front lower side, the right lower side, and the right side of the outer edge of the housing 2, that is, which can be elongated in the direction of the array of the light sources 4 and has generally an angular "U" shape lying on its side when viewed from the front thereof. The inner lens 5 can have a light guide portion 51 and a diffusing portion 52.

Figure 6:
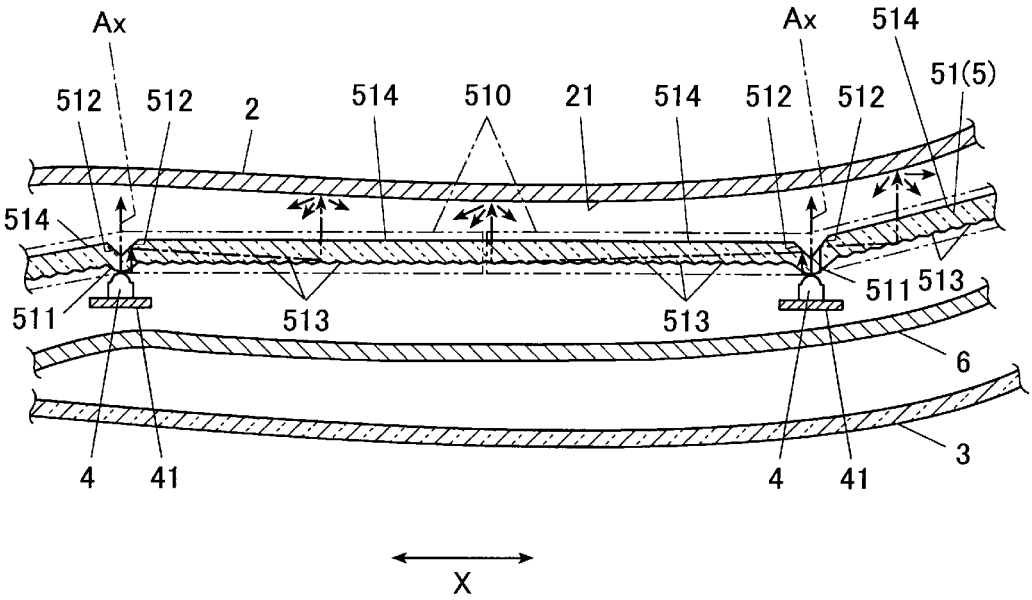
FIG. 6 is a cross-sectional view taken along line VI-VI of FIG. 2.
Figure 6:
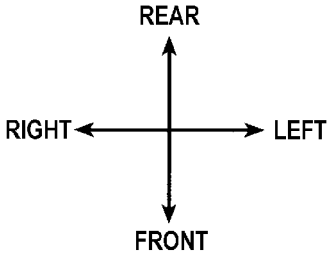

As shown in FIG. 6, the light guide portion 51 of these components can be configured to be elongated across the entire length of the inner lens 5 and disposed along the optical axis Ax of the light sources 4 (hereinafter referred to as the optical axis Ax direction; the backward direction in FIG. 6). The light guide portion 51 can be formed in such a shape that a plurality of light guide blocks 510 associated with the plurality of the light sources 4 can be coupled to each other in the longitudinal direction X (generally in the right-to-left direction in FIG. 6).

The light guide block 510 can be configured to be elongated in a manner such that the position of the corresponding light source 4 is located at the center in the longitudinal direction X and generally in the middle position between that light source 4 and a light source 4 adjacent thereto is located at an end in the longitudinal direction X. The light guide blocks 510 each have an incidence face 511, a pair of first reflecting faces 512, a plurality of second reflecting faces 513, and emission faces 514.

The incidence face 511 can be a convex surface (aspherical surface) formed to be projected at the position opposed to the corresponding light source 4, and disposed so that the light source 4 is located at or near the focus thereof, allowing the light emitted from the light source 4 to be incident upon the light guide block 510 while being refracted in the optical axis Ax direction.

The first reflecting faces 512 can be formed in pairs to be recessed on a face opposite to the incidence face 511 so as to be positioned in the optical axis Ax direction relative to the incidence face 511. More specifically, the first reflecting face 512 can be inclined from a point as an inflection on the optical axis Ax to both sides in the longitudinal direction X, and can internally reflect the light incident from the incidence face 511 on the light guide block 510 so as to branch the light into both sides of the optical axis Ax in the longitudinal direction X.

The second reflecting faces 513 can be formed in plurality on both sides of the incidence face 511 in the longitudinal direction X and arranged in a manner such that those of the faces 513 which are located farther away in the longitudinal direction X from the light source 4 opposed to the incidence face 511 are more aligned with the optical axis Ax direction. The faces 513 can form a step-wise surface by being alternately linked in the longitudinal direction X to the step faces that are coupled therebetween. The second reflecting faces 513 can be each formed to be positioned on both sides of the first reflecting face 512 in the longitudinal direction X as well as to be parallel to the nearer of a pair of the first reflecting faces 512. The second reflecting faces 513 can internally reflect individually in the optical axis Ax direction the beams of light which have been branched and internally reflected at the first reflecting face 512 to both sides thereof in the longitudinal direction X. As can be seen in FIG. 6, the second reflecting faces 513 are configured to receive and reflect light reflected from the first reflecting face 512 into a direction of optical axis Ax toward the diffusion reflector 2 and, accordingly, are formed in a stepwise manner from a nearer-side face 513 to a farther-side face 513. Further, the second reflecting faces 513 can be substantially parallel with the nearer first reflecting face 512. In other words, the relation between the optical axis Ax and each second reflecting face 513 can be constant in angle. In order to receive light from the first reflecting face 512, the second reflecting faces 513 are arranged such that the nearer second reflecting faces 513 are positioned nearer the light source level (lower side in FIG. 6) whereas the farther second reflecting faces are positioned farther from the light source level (upper side in FIG. 6) so that the second reflecting faces 513, in their entirety, form steps. Accordingly, the second reflecting faces 513 located farther away in the longitudinal direction of the lens from the light source are arranged to be more forward in the optical axis direction along the light travelling direction.

The emission face 514, which can be each elongated in the longitudinal direction X, can be disposed on both sides of the first reflecting face 512 in the longitudinal direction X so as to be located in the optical axis Ax direction relative to the second reflecting faces 513. The emission face 514 allows the light internally reflected on the second reflecting faces 513 in the optical axis Ax direction to come out of the light guide blocks 510.

In addition, as shown in FIGS. 3 to 5, the diffusing portion 52 can be disposed so as to serve as a cover in front of the second diffusion reflector 22 and coupled to an outer end of the light guide portion 51 across the entire length of the inner lens 5. The diffusing portion 52 can be formed in a curved-plate shape so as to be gradually curved in the backward direction and can have both front and rear surfaces grained to diffuse the light that passes through the diffusing portion 52.

The extension 6 can be disposed so as to serve as a cover in front of the light source 4 while exposing the diffusing portion 52 of the inner lens 5. The extension 6 can be configured to hide the light sources 4 so that the light sources 4 cannot be visually identified from outside through the outer lens 3.

As shown in FIG. 6, in the vehicle light 1 configured as described above, the light emitted from the light sources 4 radially about the optical axis Ax direction can enter the light guide blocks 510 while being refracted in the optical axis Ax direction by the incidence face 511 of the corresponding light guide block 510 of the light guide portion 51 of the inner lens 5. The light can be internally reflected on a pair of the first reflecting faces 512 while being branched into both sides of the optical axis Ax in the longitudinal direction X, and then internally individually reflected in the optical axis Ax direction while being dispersed in the longitudinal direction X by the second reflecting faces 513 that are discontinuously distributed in the longitudinal direction X. The light can then be projected from the light guide blocks 510 (the light guide portion 51) through the emission face 514.

As shown in FIGS. 3 to 5, the light emitted from the light guide portion 51 of the inner lens 5 can be diffused and reflected on the first diffusion reflector 21 and again diffused and reflected on the second diffusion reflector 22 to be directed to the diffusing portion 52 of the inner lens 5. Then, the light can pass through the diffusing portion 52 while being further diffused through both the front and rear grained surfaces of the diffusing portion 52, and thereafter, can be projected outward through the outer lens 3.

This allows for providing uniform emission through the area of the outer lens 3 opposed to the diffusing portion 52 of the inner lens 5, that is, the elongated area along the outer edge of the outer lens 3.

According to the vehicle light 1 configured as described above, the light emitted from the light sources 4 in the optical axis Ax direction can be dispersed in the longitudinal direction X by the light guide portion 51 of the inner lens 5 which is elongated in the array direction of the light sources 4. Accordingly, when compared with the conventional vehicle light which provides little or no control of the light in the longitudinal direction of the lens (the light guide plate), a fewer number of light sources 4 can provide emission through the elongated area along the longitudinal direction X.

Furthermore, the light emitted from the light guide portion 51 of the inner lens 5 can be diffused and reflected on the first diffusion reflector 21 and the second diffusion reflector 22 which are elongated along the longitudinal direction X. Accordingly, unlike the conventional vehicle light which employs a reflective structure such as of reflective dots to simply reflect light thereon in order to provide emission from the front face of the lens (the light guide plate), variations in brightness depending on the distance from the light source or the reflective dots can be prevented or the variations in brightness can be alleviated, and thus more uniform light emission can be provided through the elongated area along the longitudinal direction X.

Furthermore, the light diffused and reflected on the first diffusion reflector 21 and the second diffusion reflector 22 can further be diffused by the diffusing portion 52 of the inner lens 5. It is thus possible to provide further uniform light emission through the elongated area along the longitudinal direction X.

Furthermore, the light guide portion 51 and the diffusing portion 52 can be integrated with each other as the inner lens 5, the parts count in the case of which is reduced as compared with the count of those components when employed separately.

Furthermore, since the elongated area along the outer edge of the outer lens 3 (the vehicle light 1) can provide emission, the design of light emission can show a great deal of outstanding originality.

Note that the embodiments described herein are exemplary and applicant's disclosure should not be limited to those disclosed embodiments. These disclosed embodiments may be modified or changed as appropriate without deviating from the scope and spirit of the applicant's disclosure.

For example, in the aforementioned exemplary embodiment, the first diffusion reflector 21 and the second diffusion reflector 22 are painted white. However, either one of the first diffusion reflector 21 and the second diffusion reflector 22 can be employed as a regular reflector, which is subjected to a surface treatment such as aluminum vapor deposition to allow light to be regularly reflected on the regular reflector. This arrangement can provide light with a higher intensity when compared with the case where both the first diffusion reflector 21 and the second diffusion reflector 22 are painted white. Nevertheless, in this case, more uniform emission can be provided through the emission surface (the outer lens 3) when light is diffused and reflected not on the first diffusion reflector 21 but on the second diffusion reflector 22 that is closer to the emission surface.

Furthermore, although the two surfaces, i.e., the first diffusion reflector 21 and the second diffusion reflector 22 are employed to diffuse and reflect light, only one diffusion reflector may be required as long as the single diffusion reflector can reflect light into the diffusing portion 52 of the inner lens 5 while diffusing the light.

Furthermore, graining may not necessarily be provided to both the front and rear surfaces of the diffusing portion 52 of the inner lens 5 but may also be provided to at least one of the front and rear surfaces. Furthermore, graining can also be replaced with another method which enables diffusing of light, for example, the diffusing portion 52 may be made of a milk-white material or the diffusing portion 52 may be mixed with a diffusing agent.

It will be apparent to those skilled in the art that various modifications and variations can be made in the presently disclosed subject matter without departing from the spirit or scope of the presently disclosed subject matter. Thus, it is intended that the presently disclosed subject matter cover the modifications and variations of the presently disclosed subject matter provided they come within the scope of the appended claims and their equivalents. All related art references described above are hereby incorporated in their entirety by reference.

What is claimed is:

1. A vehicle light, comprising:

a plurality of light sources arranged in a predetermined array direction, each light source having an optical axis orthogonal to the array direction, and each light source configured to emit light in a direction of the optical axis;

a lens elongated in the array direction and disposed along the optical axis of the plurality of light sources, the lens configured to transmit light emitted from the plurality of light sources in the optical axis direction, the light being dispersed in a longitudinal direction of the lens; and a diffusion reflector elongated in the longitudinal direction of the lens and disposed along the optical axis of the lens, the diffusion reflector configured to diffuse and reflect light emitted from the lens, wherein the lens includes a plurality of light guide blocks associated with the plurality of light sources and coupled in the longitudinal direction of the lens, and the plurality of light guide blocks each include:

an incidence face opposed to a respective one of the light sources;

a first reflecting face configured to internally reflect light in the longitudinal direction of the lens, the light having passed through the incidence face into the light guide block;

a plurality of second reflecting faces configured to internally reflect light in the optical axis direction of the lens, the light having been internally reflected from the first reflecting face, those of the second reflecting faces located farther away in the longitudinal direction of the lens from the light source opposed to the incidence face being arranged to be more aligned with the optical axis direction; and an emission face configured to allow the light internally reflected from the plurality of second reflecting faces to be projected out of the light guide block.

2. The vehicle light according to claim 1, wherein the lens has a diffusing portion configured to further diffuse the light having been diffused and reflected by the diffusion reflector.

3. The vehicle light according to claim 2, wherein the array direction and the longitudinal direction are oriented along an outer edge of the vehicle light.

4. The vehicle light according to claim 1, wherein the diffusion reflector is painted white or formed of a white-colored raw material.

5. The vehicle light according to claim 4, wherein the array direction and the longitudinal direction are oriented along an outer edge of the vehicle light.

6. The vehicle light according to claim 2, wherein the diffusion reflector is painted white or formed of a white-colored raw material.

7. The vehicle light according to claim 1, wherein the array direction and the longitudinal direction are oriented along an outer edge of the vehicle light.

8. The vehicle light according to claim 1, wherein the lens includes a plurality of light guide blocks associated with the plurality of light sources, the plurality of light guide blocks each include:

an incidence face opposed to a respective one of the light sources;

a first reflecting face configured to internally reflect light in the longitudinal direction of the lens, the light having passed through the incidence face into the light guide block;

a plurality of second reflecting faces configured to internally reflect light in the optical axis direction of the lens and toward the diffusion reflector, the second reflecting faces include a nearer second reflecting face located adjacent the first reflecting face, and a farther second reflecting face located further from the first reflecting face than the nearer second reflecting face, the nearer second reflecting face being positioned nearer a light source level in the optical axis direction, and the farther second reflecting face being positioned farther from the light source level in the optical axis direction than is the nearer second reflecting face.

9. The vehicle light according to claim 1, wherein the lens includes a plurality of light guide blocks associated with the plurality of light sources, the plurality of light guide blocks each include:

an incidence face opposed to a respective one of the light sources;

a first reflecting face configured to internally reflect light in the longitudinal direction of the lens, the light having passed through the incidence face into the light guide block;

a plurality of second reflecting faces configured to internally reflect light in the optical axis direction of the lens and toward the diffusion reflector, the second reflecting faces include a nearer second reflecting face located adjacent the first reflecting face, and a farther second reflecting face located further from the first reflecting face than the nearer second reflecting face, and the farther second reflecting face being positioned closer to the diffusion reflector than is the nearer second reflecting face.

10. A vehicle light, comprising:

a housing having a front end opening and an outer edge, the outer edge including a first diffuser reflector and a second diffuser reflector;

a plurality of light sources forming an array, the plurality of light sources having an optical axis orthogonal to a direction of the array, the plurality of light sources arranged to oppose the first diffusion reflector;

an inner lens adjacent the plurality of lens sources, the inner lens elongated in the direction of the array, the inner lens including a light guide portion and a diffusing portion, the light guide portion elongated across a length of the inner lens and disposed along the optical axis of the plurality of light sources.

11. The vehicle light according to claim 10, wherein the first diffuser reflector has a planar shape and the second diffuser reflector has a curved shape.

12. The vehicle light according to claim 10, herein the first diffuser and the second diffuser are painted white.

13. The vehicle light according to claim 10, wherein the light guide portion includes a plurality of light guide blocks which are associated with the plurality of light sources, the plurality of light guide blocks each having an incidence face, a pair of first reflecting faces, a plurality of second reflecting faces and an emission face.

14. The vehicle light according to claim 13, wherein the incidence face has a convex surface.

* * * * *